US005559499A

United States Patent [19]

Haubner

[11] Patent Number: 5,559,499

[45] Date of Patent: Sep. 24, 1996

[54] RECEIVER FOR THE RECEPTION OF WIRELESSLY TRANSMITTED INFORMATION

[75] Inventor: Georg Haubner, Berg, Germany

[73] Assignee: Robert Bosch GmbH, Stuttgart, Germany

[21] Appl. No.: 256,982

[22] PCT Filed: Dec. 19, 1992

[86] PCT No.: PCT/DE92/01067

§ 371 Date: Aug. 1, 1994

§ 102(e) Date: Aug. 1, 1994

[87] PCT Pub. No.: WO93/15486

PCT Pub. Date: Aug. 5, 1993

[30] Foreign Application Priority Data

Jan. 31, 1992 [DE] Germany ..... 42 02 759.4

[51] Int. Cl.[6] ..... G08B 21/00

[52] U.S. Cl. ..... 340/636; 340/635; 341/173; 341/178; 455/38.3; 455/38.4

[58] Field of Search ..... 340/635, 636; 341/173, 178, 183; 371/25.1; 455/38.3, 38.4, 127, 343, 353

[56] References Cited

U.S. PATENT DOCUMENTS

| | | | |
|---|---|---|---|
| 3,891,985 | 6/1975 | Oigarden et al. | 341/178 |
| 4,207,524 | 10/1980 | Purchase | 375/22 |
| 4,514,731 | 4/1985 | Falck et al. | 340/636 |
| 4,608,714 | 8/1986 | Juengel | 340/636 |
| 4,622,544 | 11/1986 | Bially et al. | 340/636 |
| 4,837,779 | 6/1989 | Lundgren | 340/636 |
| 4,897,662 | 1/1990 | Lee et al. | 340/636 |
| 4,914,393 | 4/1990 | Yoshido | 340/636 |
| 4,977,353 | 12/1990 | Helal et al. | 340/636 |
| 5,140,310 | 8/1992 | DeLuca et al. | 340/636 |
| 5,247,295 | 9/1993 | Kanda | 341/173 |

FOREIGN PATENT DOCUMENTS

| | | |
|---|---|---|
| 0453957 | 10/1991 | European Pat. Off. . |
| 2824421 | 12/1979 | Germany . |
| 2848533 | 5/1980 | Germany . |
| 3791043 | 5/1989 | Germany . |
| 4202759 | 4/1994 | Germany . |

*Primary Examiner*—John K. Peng
*Assistant Examiner*—Ashok Mannava
*Attorney, Agent, or Firm*—Michael J. Striker

[57] ABSTRACT

The invention is directed to a receiver for receiving information transmitted without the use of wires, in particular by infrared light signals. The information is transmitted by a battery-operated transmitter provided with a display unit which delivers an appropriate signal depending on the completeness of the information (FIG. 1).

8 Claims, 6 Drawing Sheets

RECEIVER FOR THE RECEPTION OF WIRELESSLY TRANSMITTED INFORMATION

PRIOR ART

The invention is based on a receiver for receiving information transmitted without the use of wires, in particular by infrared signals, according to the generic part of the main claim. A receiver is already known from DE-OS 28 24 421. This receiver contains a microprocessor, a memory and a receiving unit. However, this receiver is not provided with a display unit so that it is impossible to display the reception status of the receiver. Further, it is known from DE-OS 28 48 533 to provide the receiver with a display unit which displays the status (active/inactive) of an alarm system connected to tile receiver. The alarm system is installed along with the receiving unit and display unit, e.g. in a motor vehicle, and can be switched on and off by remote control with a battery-operated transmitter. Two light-emitting diodes (red/green) in the display unit show whether the alarm system is switched on or off.

ADVANTAGES OF THE INVENTION

The receiver according to the invention with the characterizing features of the main claim has the advantage over the prior art that it displays the reception status. Accordingly, the user receives an acknowledgement as to whether or not the information transmitted by the user by a battery-operated transmitter has successfully reached the receiving unit. In the absence of an acknowledgment and if the transmission is not successful after repeated attempts, it remains unclear which device (transmitter or receiver) contains the error. This can lead to unnecessary replacement of the receiver module or transmitter module. Such unneeded repairs are prevented by the subject matter of the present invention.

Advantageous further developments and improvements in the receiver indicated in the main claim are made possible by the steps contained in the subclaims. In the event of incomplete information it is advantageous, for example, to activate the display unit to output an incompleteness signal. This incompleteness signal could, at the same time, request a change of battery in the transmitter, for example. This is an error which occurs frequently in practice and is manifested by partial receipt of information by the receiver, after which information is no longer correctly received because the transmission becomes increasingly weaker when the transmitter battery is defective.

DRAWING

An embodiment example of the invention is shown in the drawing and explained more fully in the following description.

Figure 5:
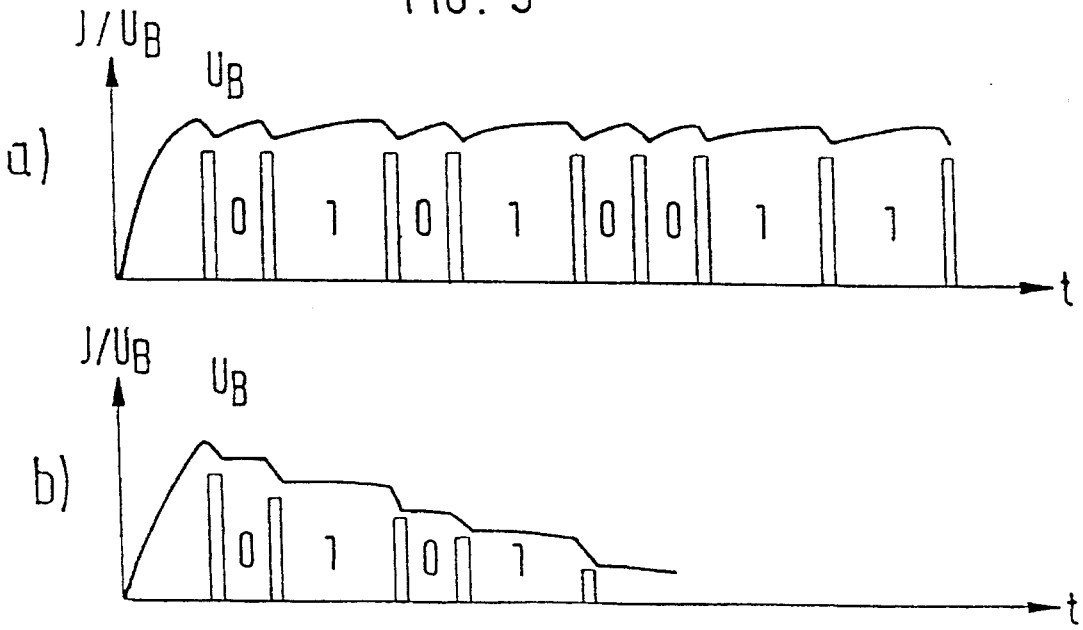
Figure 6:
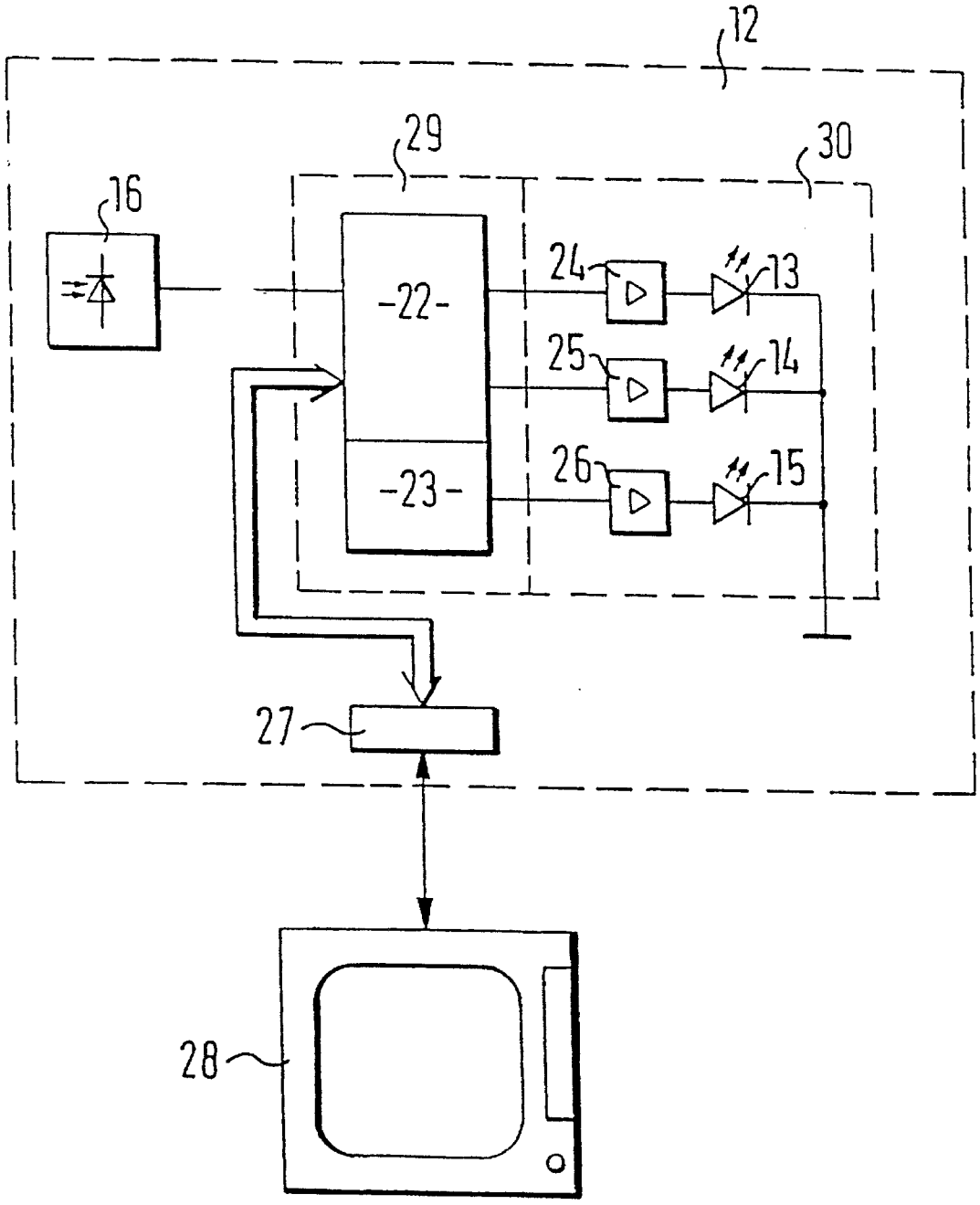
Figure 7A:
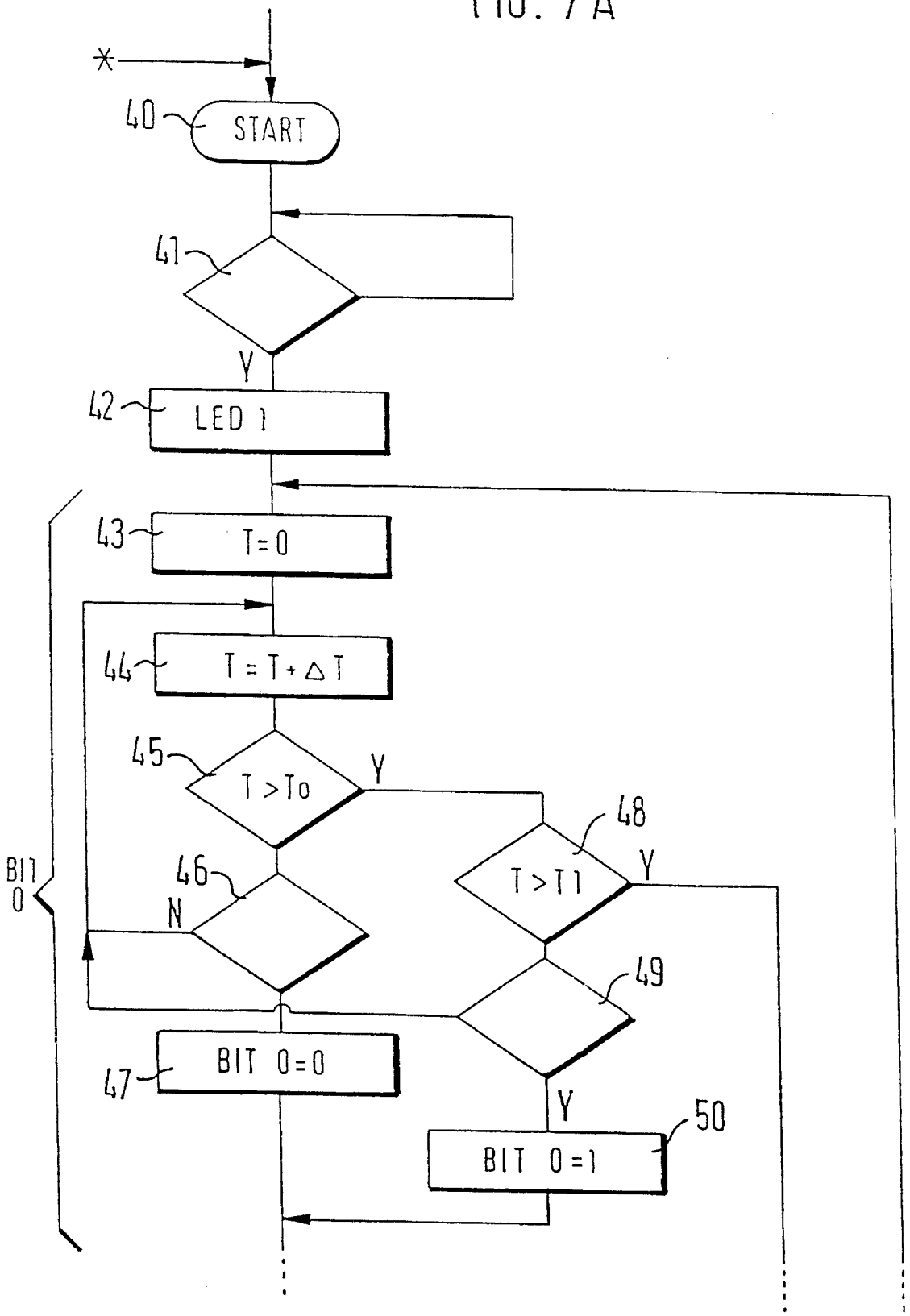
Figure 7B:
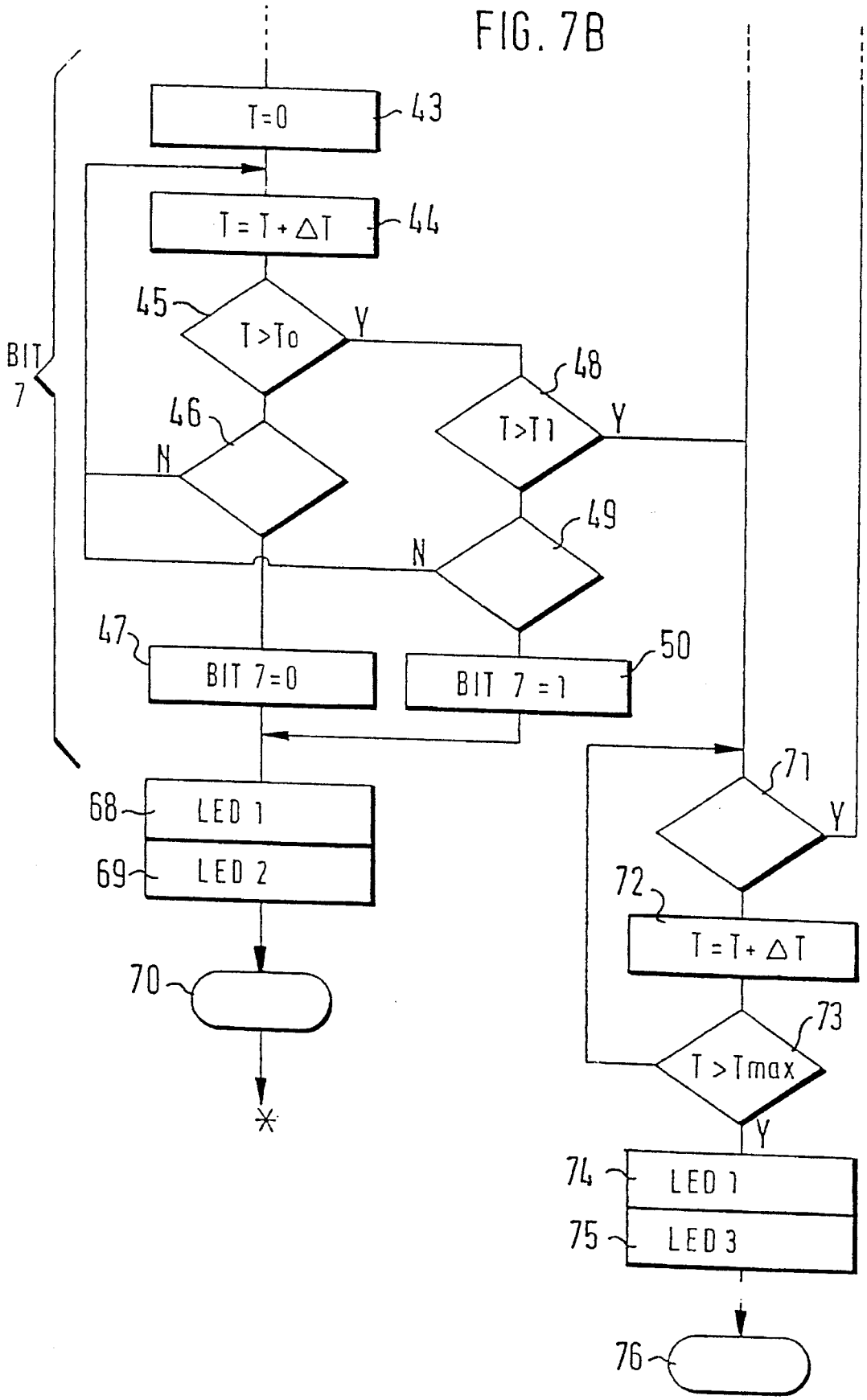
Figure 8:
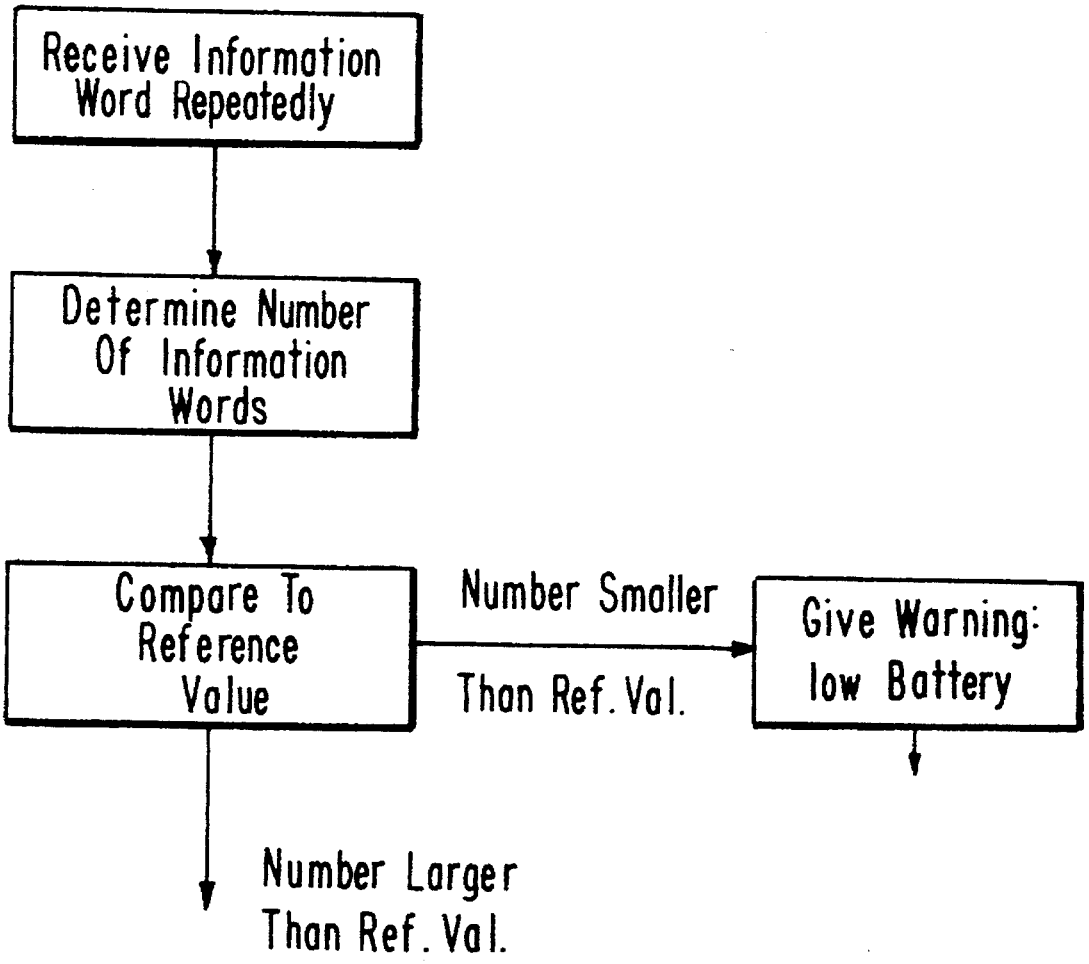

FIG. 5*a* shows the voltage: and current curve of the light emitter in the transmitter with well-charged battery;

FIG. 5*b* shows the voltage and current curve of the light emitter in the transmitter with discharged battery;

FIG. 6 shows a block diagram of the receiver;

FIG. 7 shows a structogram for a program to be run in the evaluating unit of the receiver.

DESCRIPTION OF THE EMBODIMENT EXAMPLE

Figure 1:
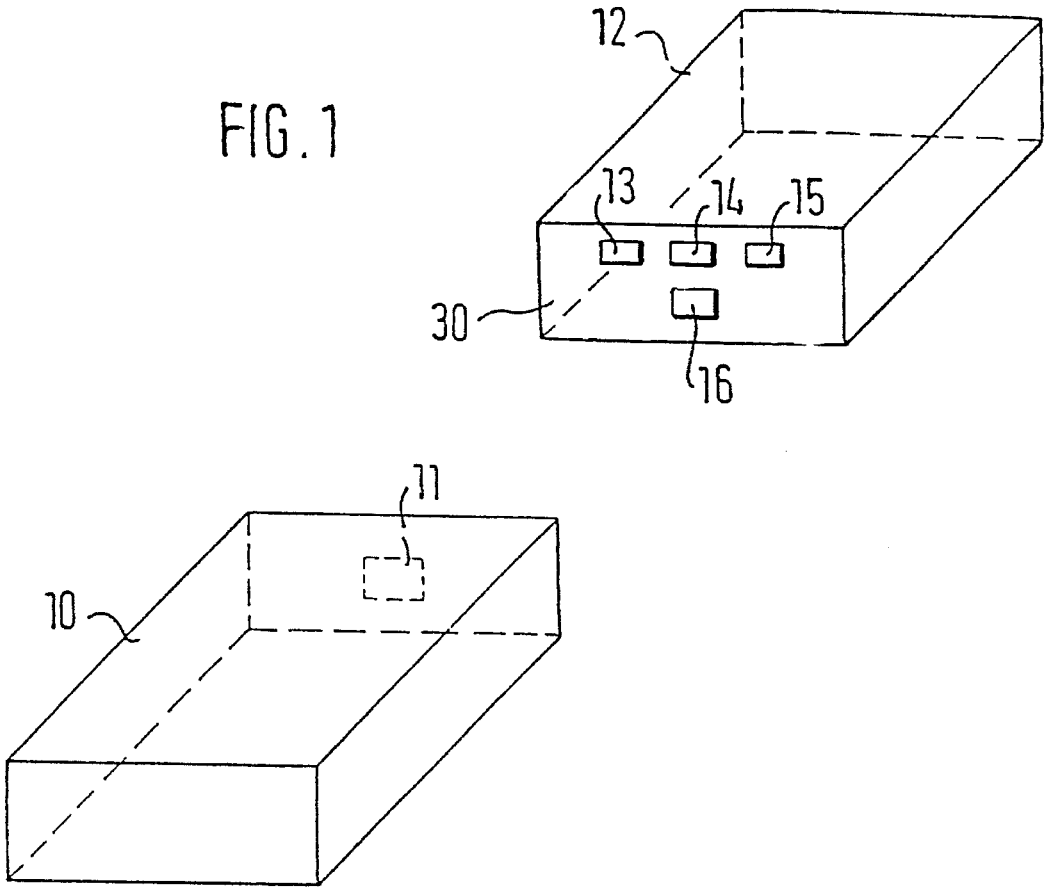
FIG. 1 shows a schematic view of a transmitter/receiver device.

FIG. 1 shows an IR transmitter 10 with an infrared transmitting diode 11 and an IR receiver 12 with a light receiver 16 and light-emitting diodes 13, 14 and 15 as display unit 30. For example, the IR transmitter 10 can be a remote-control transmitter for a wide range of applications including televisions, stereo systems, motor vehicle alarm systems, door locking mechanisms, video recorders, satellite reception installations, etc. The IR receiver 12 can be integrated in the device to be controlled for the respective application.

Figure 2:
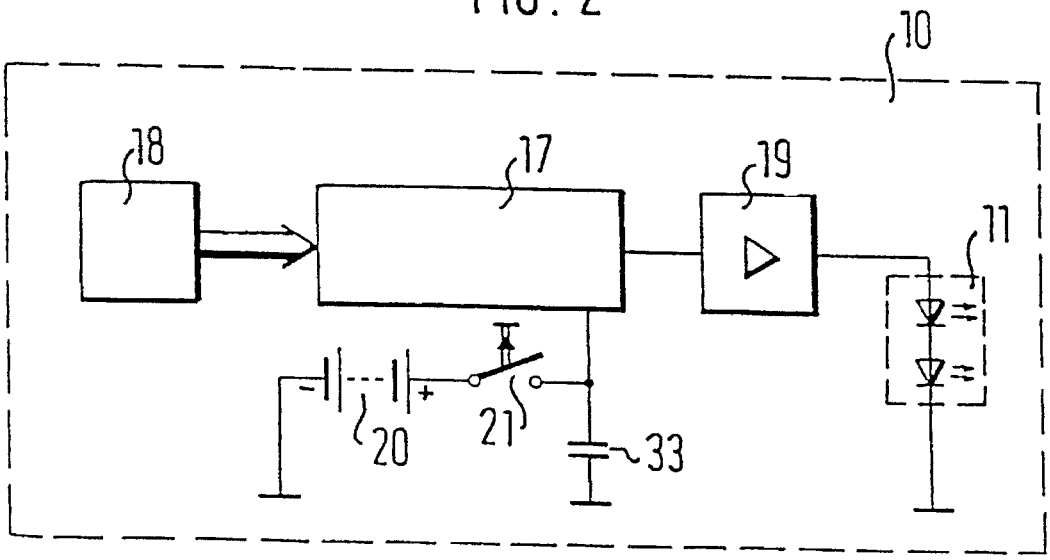
FIG. 2 shows a block diagram of a transmitter.

FIG. 2 shows the formal construction of an IR transmitter 10 in a block diagram. The transmitter 10 has a microprocessor 17 and a key-actuated memory 18 connected to the latter. Further, a driver stage 19 is connected to the microprocessor 17. This driver stage 19 is connected in turn with a light emitter 11. A battery 20 which can supply power to the microprocessor 17 by activating a push-button 21 is provided in the IR transmitter 10 as power source. The IR transmitter 10 is put into operation via the push-button 21. By pressing down on the button 21, the capacitor 33 is charged and continues to supply current for a certain period of time after the button 21 has been released. This ensures that sufficient current will be available for transmitting information even when the button 21 is pressed briefly. The microprocessor 17 then runs a program which is stored in the memory 18, preferably a read-only memory. By appropriate control on the part of the driver stage 19, a determined pulse sequence of IR light signals is transmitted by the light emitter 11. The pulse sequence is fixed and triggers a determined control function in the receiving device which is integrated in the receiver 12. If the memory is constructed as a key-actuated matrix memory, a wide range of control functions are possible, depending on the application. For example, the pulse sequence may be used to switch on an alarm system, unlock a door, change the volume level of a stereo system, fast-forward or rewind a video recorder, change channels on a television set, actuate the polarizer on a satellite antenna system, etc.

Figure 3:
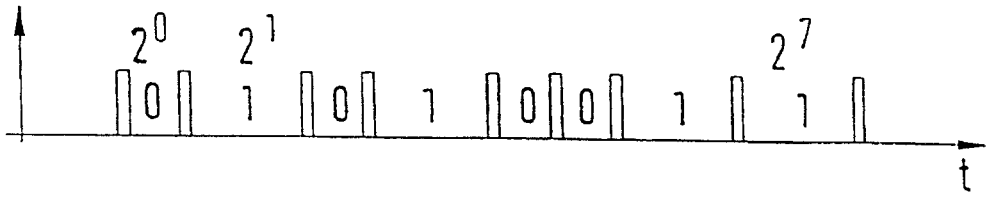
FIG. 3 shows the light signal for the transmission of an information word.
Figure 4:
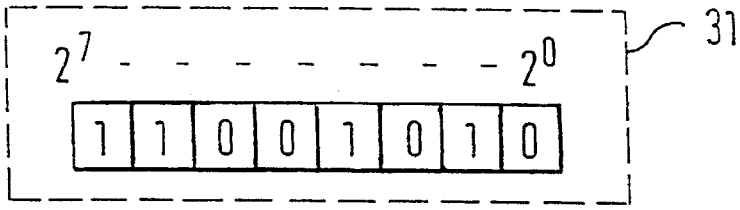
FIG. 4 shows the: information word corresponding to the light signals of FIG. 3.

A possible pulse sequence is illustrated in FIG. 3. A binary information word is transmitted to the receiver 12 by way of this pulse sequence of light signals. All of the light signals are of the same duration. Different durations between the light signals designate a bit state of 0 or 1. This corresponds to a bit-serial, pulse-width-modulated data transmission. The information word transmitted by the pulse sequence of FIG. 3 is shown in FIG. 4. It is composed of eight bits. Additional check bits such as parity bits, etc. and start and stop bits for the data transmission can be added to the information word. A total of 256 different control functions can be transmitted to the receiver with the transmission of an 8-bit information word. However, it is also possible to transmit a plurality of information words to the receiver 12 one after the other. Accordingly, more than 256 pieces of information can be transmitted to the receiver 12. If a plurality of information words are transmitted to the receiver consecutively, it is advisable to wait for a synchronization period between the information words.

FIG. 5*a* shows the voltage and current curve in the light emitter 11 of the transmitter 10 when the battery 20 of the transmitter 10 has a normal state of charge. The current curve corresponds in this case to the pulse sequence of light signals as shown in FIG. 3.

In contrast, FIG. 5*b* shows the voltage and current curve in the light emitter 11 of the transmitter 10 when the battery 20 of the transmitter 10 is charged below normal. It will be seen that the individual current pulses become progressively weaker with time and the voltage likewise breaks down progressively over time. Accordingly, not all of the light pulses for the information word to be transmitted are sent in this case. The receiver 12 is then incapable of receiving the information word 31 in its entirety.

FIG. 6 shows the receiver 12. This receiver 12 contains an evaluating unit 29 and a display unit 30 connected thereto. The receiving unit 16 and a serial interface 27 are connected to the evaluating unit 29. The serial interface 27 is connected with a video display 28. The receiver 12 is preferably integrated in the video display 28. The evaluating unit 29 contains a microprocessor 22 and a memory 23. Three driver stages 24, 25, 26 and three light-emitting diodes 13, 14, 15 are shown in the display unit 30. However, a LCD or seven-segment display, etc., can also be used. The operation of the receiver 12 is explained in the following with reference to the flow chart in FIG. 7.

FIG. 7 shows a flow chart for a program which is stored in the memory 23 of the receiver 12 and run by the microprocessor 22. Program step 40 shows the start of the program when power is supplied to the receiver 12. The program then waits for the input of a light pulse. When a light pulse is detected in inquiry 41, the first light-emitting diode 13 is triggered in program step 42. When this light-emitting diode 13 is triggered by driver stage 24, this means that information is being input. After this, a time counter T is set to 0 in program step 43. In program step 44, the time counter T is increased by 1 increment ($\Delta T$). The value $\Delta T$ corresponds to the time required to execute program steps 44, 45 and 46. In inquiry 45, the counter state of the time counter T is compared with a preset limiting value $T_0$. If the counter state T has not yet reached this limiting value $T_0$, inquiry 46 ascertains whether or not an additional light pulse has been received. If so, the bit state of the first bit 0 of the information word is determined as 0 in program step 47. If the receipt of a light pulse was not detected in inquiry 46, the program proceeds to program step 44. If inquiry 45 determines that the limiting value has been exceeded, the counter state T is compared in inquiry 48 with a second limiting value $T_1$. If the counter state T is less than or equal to the limiting value $T_1$, inquiry 49 ascertains whether or not a light pulse has been received in the meantime, If not, the program again proceeds to program step 44. If inquiry 49 determines that a light pulse has been detected, the bit state of the first bit 0 of the information word is established as 1 in program step 50. If inquiry 48 has determined that the limiting value has once again been exceeded in the time counter T, the program jumps to inquiry 71 and again checks whether or not a light pulse was received. If not,, the time counter T is increased again in program step 72 and another inquiry 73 is carried out to check the time counter T. If the time counter reading is less than the limiting value $T_{max}$, the program proceeds to inquiry 71. If the time counter status is greater than $T_{max}$, the first light-emitting diode 13 is switched off in program step 74 and the third light-emitting diode 15 is subsequently switched on in program step 75. This means that the received information is incomplete. It can also be made to mean that the battery in the transmitter 10 needs to be changed. Then, in program step 76, the program is interrupted and/or other program parts are called up, e.g. for displaying an error message on the screen 28 via the serial interface 27. If a light pulse is determined in inquiry 71, it is assumed that a new start pulse is present and the program proceeds with program step 43.

If inquiry 48 does not determine that the limiting value has been exceeded and the bit state is determined as "0" in program step 47 or as "1" in program step 50, program steps 43 to 50 are executed in an identical manner, apart from the fact that the bit state of the first bit 0 of the information word 31 is not determined in program steps 47 and 50, but rather the bit state of the second bit 1 and, successively, bits 2, 3, 4 to 7 are evaluated in program steps 47 and 50. If all bits of the information word 31 were correctly received in the manner described above, the first light-emitting diode 13 is switched off in program step 68 and the second light-emitting diode 14 is switched on in program step 69. Since the information words are transmitted within a very short time, the light-emitting diode 13 can also be controlled by an additional control circuit in such a way that a light signal of sufficient duration is transmitted. The second light-emitting diode 14 then signals the completeness of the received information. It can also be switched on only for a certain length of time when suitable means are provided. The program then proceeds with another program 70. This program part serves, for example, to decrypt the received information and to execute the control function corresponding to the information. It is also possible, after transmitting the corresponding control commands via the serial interface 27 to the video display 28 for the control function to be executed automatically by the video display 28 itself. The displayed messages (complete/incomplete information received, battery change required in transmitter, etc.) can also be output by the serial interface 27 and/or via the video display 28.

In a further development of the invention, means can be provided which enable transmission with ultrasonic signals, for example, rather than with electromagnetic waves. When appropriate means are provided, it is also possible when transmitting the individual bits of the information words to assign a fixed transmission time to each bit of the information word and to distinguish between bit states of 0 and 1 based on the presence or absence of light energy or sound energy.

In order to detect the need for a change of battery in the transmitter 10 in a more accurate manner, it is advisable in another construction of the invention to measure and evaluate the strength of the received light pulse as a function of the number of received light pulses. When pulse chains are transmitted repeatedly, the number of pulse chains can also be measured and stored as a learning word. A decrease in the number of pulse chains represents an early detection of diminishing battery capacity. An acknowledgement signal can also be sent to the transmitter. A decrease in a mean number of transmitted pulses per pulse chain can also be used as an early warning of decreased battery capacity.

I claim:

1. A receiver for receiving information transmitted without the use of wires by infrared signals, which information is transmitted by a battery-operated transmitter in form of at least one information word including a plurality of bits, the receiver comprising an evaluating unit which evaluates received pulses and recognizes from the received pulse a diminishing of a battery capacity in a sending device; a display unit controlled for sending a warning signal when said evaluating unit recognizes a diminishing of the battery capacity of the sending device, said evaluating unit being designed so that it determines during a receiving process at least a number of completely received information words, said display unit being controlled for sending the warning signal when the number of the completely received information words is smaller than a predetermined reference value thus indicating the diminishing of the battery capacity.

2. A receiver as defined in claim 1, wherein the receiver is formed so that it waits for a synchronized period between the individual information words when receiving a plurality of the information words.

3. A receiver as defined in claim 1, wherein the receiver is formed so that it successively increases a time counter between the received signals.

4. A receiver as defined in claim 1, wherein said receiver is formed so that it compares a status of a time counter with predetermined limiting values, and results of the comparison establish a respective bit state of a received information.

5. A receiver as defined in claim 1, wherein said receiver is formed so that it compares a status of a time counter with predetermined limiting values, and results of the comparison establish a completeness of a received information.

6. A receiver as defined in claim 1; and further comprising a video screen, said screen unit being electrically coupled with said video screen and the warning signal is displayed on said video screen.

7. A receiver as defined in claim 1, wherein said evaluating unit after the receipt of a pulse activates the display unit for sending a signal which displays arrival of the information words.

8. A receiver as defined in claim 1, wherein the reference value is a word which is produced from learning of a number of the received information words.

* * * * *